United States Patent [19]

Johansson et al.

[11] Patent Number: 4,848,240

[45] Date of Patent: Jul. 18, 1989

[54] TOOL FOR POSITIONING RAILWAY TRACK COMPONENTS AND METHOD OF MANUFACTURE

[75] Inventors: Arne Johansson, Karlskoga; Torsten Larsson, Nybro, both of Sweden

[73] Assignee: Aktiebolaget Bofors, Bofors, Sweden

[21] Appl. No.: 576,962

[22] Filed: Feb. 3, 1984

[30] Foreign Application Priority Data

Feb. 3, 1983 [SE] Sweden ..... 8300565

[51] Int. Cl.[4] ..... E01B 27/13

[52] U.S. Cl. ..... 104/10

[58] Field of Search ..... 104/10–14; 403/381, 333, 334, 331

[56] References Cited

U.S. PATENT DOCUMENTS

| | | | |
|---|---|---|---|
| 1,303,090 | 5/1919 | McCray | 403/331 X |
| 2,106,037 | 1/1938 | Pirich | 403/334 X |
| 3,581,664 | 6/1971 | Kruse | 104/10 |
| 4,062,291 | 12/1977 | Vick et al. | 104/10 |

*Primary Examiner*—Robert B. Reeves

*Assistant Examiner*—Frank H. Williams, Jr.

*Attorney, Agent, or Firm*—Pollock, Vande Sande & Priddy

[57] ABSTRACT

An improved tool for railway track adjustment machines is disclosed which may be made by processes forging, casting, and which includes a shaft and a blade manufactured as separate entities and force-fitted together. In making the tool the lower end of the shaft is formed so that it is able to be forced between flanges located on the rear side of the blade. This lower end preferably has a transverse cross section shaped as a trapezoid with an apex angle $\gamma$ and is upwardly and outwardly tapered at an angle $\alpha$. The flanges located on the rear side of the blade are manufactured from the same piece of material as the blade and define a slot which opens upwardly and outwardly at an angle to the direction of the longitudinal axis of the tool and the symmetrical plane of the blade. A method the slot defined between the flanges has a transverse cross section which tapers inwardly at an angle $\delta$ and may be formed by deforming the blade.

9 Claims, 1 Drawing Sheet

TOOL FOR POSITIONING RAILWAY TRACK COMPONENTS AND METHOD OF MANUFACTURE

TECHNICAL FIELD

The invention concerns devices used to position railway tracks and ties or sleepers, and methods of making such devices. More particularly, the invention concerns the spade-shaped tools used in railway building equipment to move tracks and ties to desired positions, and methods of making such tools.

BACKGROUND ART

When adjusting railway tracks, ties and similar devices to the proper position for use, very sophisticated machines often are used. These machines typically include hydraulically activated, rather simple spade-shaped tools which are used to move the tracks to the correct position. Railway track ties, or sleepers, rest on and in a bed of gravel, macadam or other ballast material. The spade-shaped tools are pressed with great force downward through this bed, then under and in toward the sleepers. Due to the great amount of wear to which the tools are subjected by the bed material, they will usually be worn out within a few days. The portion of the tools which actually wears out is the blade or working surface, while the integral support shaft experiences much less wear. In spite of this, the prior art practice has been to replace the entire tool since the tool is manufactured in one piece.

DISCLOSURE OF THE INVENTION

An object of the present invention is to provide an improved tool of the type just discussed in which it is possible to replace only those portions of the tool which are actually worn.

A further object of the invention is to provide a method of manufacturing the replaceable blade for such a tool.

These objects of the invention are given only by way of example. Thus, other desirable objectives and advantages of the invention may occur or become apparent to those skilled in the art. Nonetheless, the scope of the invention is to be limited only by the appended claims.

In a tool according to the invention, the shaft as well as the blade will become worn; however, wear on the shaft has been estimated to be approximately one tenth that of the blade. Thus, one shaft could last as long as ten blades before it has become worn to such a degree as to require replacement.

In accordance with the invention, an improved tool for incorporation in machines used to position railway tracks and ties comprises a support shaft and a blade member which is mounted by force-fit on the shaft. The support shaft has a first axis, an upper end adapted to be gripped by such machines and a lower end. The lower end is tapered upwardly and outwardly from the first axis and has a transverse cross section which tapers inwardly from the front side of the lower end toward the back side of the lower end. The blade member has a second axis, a front side, a back side and a pair flanges extending from the back side to define an upwardly extending and opening slot in which the lower end of the support shaft is received with the front side of the shaft facing the back side of the blade member. The slot in the blade member is tapered upwardly and outwardly from the second axis and has a transverse cross section which tapers inwardly toward the center of the slot, as measured from the back side of the blade member toward the outer ends of the flanges. As a result, when the lower end of the support shaft is forced into the slot on the back of the blade member, the blade member is removeably secured to the support shaft by a force fit, thereby permitting replacement of a worn blade member and reuse of the support shaft. Preferably, the flanges on the blade member are formed integrally with the blade member during casting or forging operations.

In accordance with the method of the invention for manufacturing the tool of this type, a support shaft of the type previously mentioned is formed. An intermediate form of the blade member is then formed which has a second axis, a front side, a back side and a pair of integral flanges extending from the back side to define an upwardly extending and opening slot for receiving the lower end of the support shaft, the slot being tapered upwardly and outwardly from the second axis of the blade member. Thereafter, the blade member is deformed to cause the outer end of the flanges to move toward the second axis of the blade member so that the slot thereafter has a transverse cross section which tapers inwardly toward the center of the slot, as measured from the back side of the blade member toward the outer ends of the flanges. Depending on the method used to manufacture the blade member, the initial forming step may cause the blade member to be flat or to bow toward the flanges. In the first instance, the deforming of the blade member simply comprises bending of the flanges toward the center of the slot to cause a taper to form in the transverse cross section of the slot. In the latter instance, the blade member is deformed by essentially flattening it to cause a taper to form in the transverse cross section of the slot.

BEST MODE FOR CARRYING OUT THE INVENTION

Figure 1:
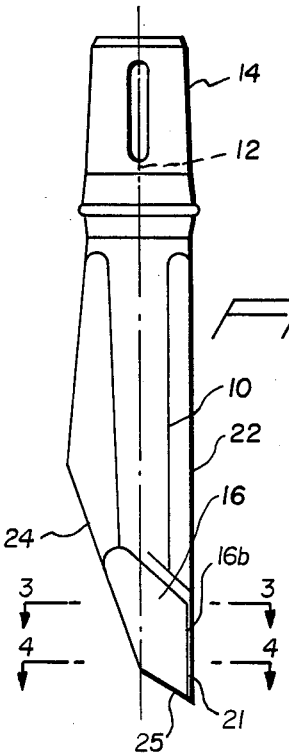
FIG. 1 shows a side view of a support shaft according to the invention.
Figure 2:
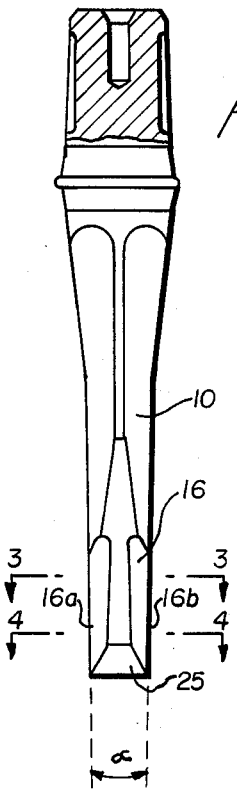
FIG. 2 shows a back view of a support shaft according to the invention, as seen from the left in FIG. 1.

The following is a detailed description of the invention, reference being made to the drawing in which like-reference numerals identify like-elements of structure in each of the several Figures.

FIGS. 1–4 show various views of a support shaft 10 according to the invention which may be made by forging, casting or machining from a suitable material such as steel. A longitudinal axis 12 extends through shaft 10 and the upper end 14 of the shaft is configured as necessary to be gripped by the machinery for positioning railway track and ties. The lower end 16 of shaft 10 is tapered upwardly and outwardly at an angle $\alpha$ measured between the side edges 16*a*, 16*b* of lower end 16.

Figure 3:
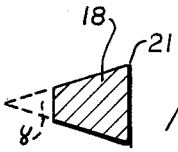
FIGS. 3 and 4 show sectional views taken along lines 3—3 and 4—4 in FIGS. 1 and 2.
Figure 4:
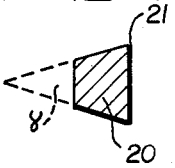

As shown in FIGS. 3 and 4, the transverse cross sections 18, 20 taken at about the upper and lower ends of lower end 16 are essentially trapezoidal in configuration except for a small rectangular portion 21 at their bases. The edges of portion 21 preferably are chamfered. Cross sections 18, 20 taper inwardly from one side 22, the front side of the shaft in use, to the other side 24, the back side of the shaft in use, at an angle $\gamma$ as shown in FIGS. 3 and 4. The very bottom of shaft 10 has a chisel-like surface 25 which extends from back side 24 to front side 22.

Figure 5:
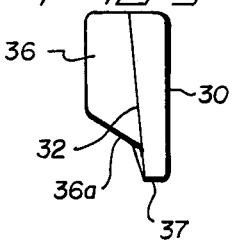
FIG. 5 shows a side view of a blade member according to the invention.
Figure 6:
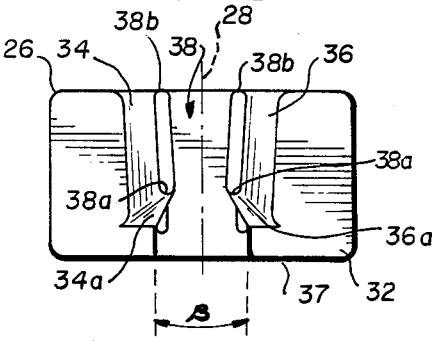
FIG. 6 shows a rear view of a blade member according to the invention.
Figure 7:
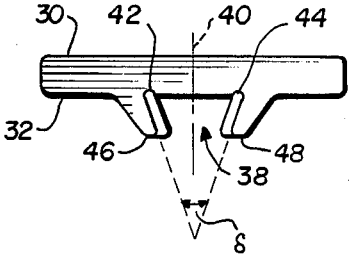
FIG. 7 shows a top view of a blade member according to the invention.

As shown in FIGS. 5–7, the blade member 26 according to the invention includes a central vertical axis 28, a front side 30 and back side 32. The overall shape of the front and back sides is essentially rectangular; however, as shown in FIG. 5, the vertical cross section of the blade member 26 is essentially trapezoidal and tapered downwardly and toward front side 30 from the top edge of the blade. On the back side 32, a pair of flanges 34, 36 are provided which preferably are formed integrally with the blade during manufacture. The flanges are essentially rectangular in shape, although their lower edges 34*a*, 36*a* slope downwardly toward front side 30 and the lower edge 37 of the blade; so that, the lower edge 37 is of a relatively uniform thickness as best seen in FIG. 5.

Between flanges 34, 36, an upwardly and outwardly tapered slot 38 is defined which extends upwardly from the lower ends 38*a* of the flanges 34, 36 and outwardly at an angle $\beta$ to the upper ends 38*b* of the flanges. Slot 38 preferably is symmetrical about axis 28. As shown in FIG. 7, slot 38 includes a transverse axis 40 and the transverse cross section of the slot, at any given height along the slot, tapers inwardly toward axis 40 from the base ends 42, 44 to the outer ends 46, 48 of flanges 34, 36. Thus, as shown in FIG. 7, the transverse cross section of slot 38 tapers at an angle $\delta$ symmetrically about axis 40. The interior angles of slot 38 at base ends 42, 44 are equal.

As previously indicated, the lower end 16 of shaft 10 is tapered. Preferably, this taper is rather gradual along the widest part of lower end 16 so that the edges 16*a*, 16*b*, as extended, form an angle $\alpha$ which is less than or equal to 10 degrees. The angles $\gamma$ between the non-parallel sides of the cross sections 18, 20 shown in FIGS. 3 and 4 preferably are in the range 30 to 50 degrees and equal in magnitude. On blade member 26, the upwardly extending edges of flanges 34, 36 form an angle $\beta$ of less than or equal to 10 degrees, as shown in FIG. 6; and the horizontally extending edges of the flanges form an angle $\delta$ of 30 to 50 degrees, as shown in FIG. 7. Angles $\gamma$ and $\delta$ preferably are in the range of 30 to 50 degrees; angle $\gamma$ is less than or equal to angle $\delta$ and angle $\gamma$ and angle $\delta$ differ from each other by no more than two degrees, preferably one degree.

Figure 8:
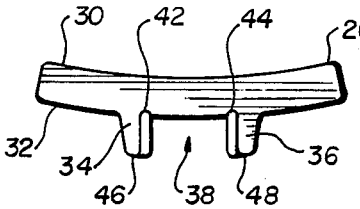
FIG. 8 shows a top view of an intermediate stage in the manufacture of the blade member in which the body of the blade member is bowed convexly toward the flanges on its back side and the transverse cross section of the slot between the flanges is not tapered.
Figure 9:
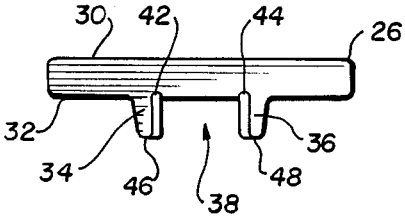
FIG. 9 shows a top view of an intermediate stage in the manufacture of the blade member in which the body of the blade member is essentially flat and the transverse cross section between the flanges is not tapered.

FIGS. 8 and 9 show intermediate forms of blade member 26 during manufacture. Depending upon the precise mode of formation used for the blade member, it may assume the form shown in FIG. 8 in which it bows convexly toward flanges 34, 36 or the form shown in FIG. 9 in which the blade is essentially flat. In either case, at any given height along the slot the transverse cross section of slot 38 is essentially rectangular, rather than inwardly tapered in the manner previously described. To achieve the necessary transverse taper in the situation shown in FIG. 8, blade member 26 is deformed as a whole, using any convenient technique, to the essentially flat configuration shown in FIG. 7. Due to such deformation, flanges 34, 36 swing inwardly to define the tapered transverse cross section. Further inward deforming of the flanges may be necessary in some instances to achieve the desired cross section. Should the blade bow concavely toward the flanges, not illustrated, straightening the blade may require subsequent local deforming of the blades inward to the desired transverse cross section. In the situation shown in FIG. 9, the flanges 34, 36 are themselves locally deformed inwardly toward axis 40 to achieve the desired taper.

Figure 10:
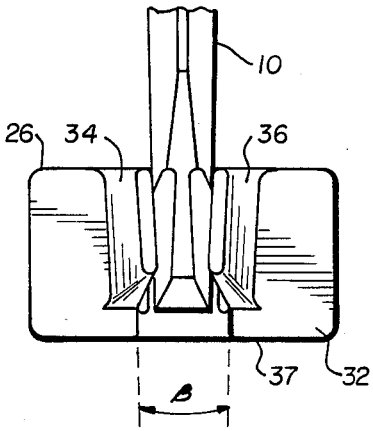
FIG. 10 shows an assembled tool according to the present invention.

To assemble the tool according to the invention, shaft 10 is inserted into slot 38 so that axes 12 and 28 coincide, as shown in FIG. 10. Means such as a heavy hammer are used to force blade member 26 into engagement with shaft 10. Or the hydraulic drive of the associated machinery may be used to seat the blade. A worn blade is simply knocked off in the opposite direction.

Having described our invention in sufficient detail to enable those skilled in the art to make and use it, we claim:

1. An improved tool for incorporation in machines used to position railway tracks and ties, comprising:

a support shaft having a first axis, an upper end adapted to be gripped by such machines and a lower end, said lower end being tapered upwardly and outwardly from said first axis, said lower end having a transverse cross section which is essentially trapezoidal in configuration; and a blade member having a second axis, a front side, a back side and a pair of flanges extending from said back side to define an upwardly extending and opening slot in which said lower end of said shaft is received with said one side of said shaft facing said back side of said blade member, said slot being tapered upwardly and outwardly from said second axis and having a transverse cross section which tapers inwardly toward the center of said slot from said back side of said blade member toward the outer ends of said flanges, whereby said lower end of said support shaft is force-fitted into said slot in said blade member to removably secure said blade member to said support shaft, thereby permitting replacement of said blade member when worn and reuse of said support shaft.

2. An improved tool according to claim 1, wherein said flanges are integral with said blade member.

3. An improved tool according to claim 1, wherein said lower end of said support shaft is tapered at an angle $\alpha$; said slot in said blade member is tapered upwardly and outwardly at an angle $\beta$ essentially equal to said angle $\alpha$; said transverse cross section of said lower end of said shaft is tapered at an angle $\gamma$; and said transverse cross section of said slot is tapered at an angle $\delta$ essentially equal to angle $\gamma$.

4. An improved tool according to claim 3, wherein each of said angles $\gamma$ and $\delta$ is in the range of 30 to 50 degrees, $\gamma$ is less than or equal to $\delta$, and $\gamma$ and $\delta$ differ from each other by no more than 2 degrees,; and angles $\alpha$ and $\beta$ are less than or equal to 10 degrees and are equal to each other.

5. A method of manufacturing a tool for incorporation in machines used to position railway tracks and ties, said method comprising the steps of:

forming a support shaft having a first axis, an upper end adapted to be gripped by such machines and a lower end, said lower end having a transverse cross section which is essentially trapezoidal in configuration;

forming a blade member having a second axis, a front side, a back side and a pair of integral flanges extending from said back side to define an upwardly extending and opening slot for receiving said lower end of said shaft with said one side of said shaft facing said back side of said blade member, said slot being tapered upwardly and outwardly from said second axis; and deforming said blade member to cause the outer ends of said flanges to move toward said second axis whereby said slot has a transverse cross section which tapers inwardly toward the center of said slot from said back side of said blade member toward the outer ends of said flanges.

6. A method according to claim 5, wherein during said forming and deforming steps said lower end of said shaft is tapered at an angle $\alpha$; said slot in said blade member is tapered upwardly and outwardly at an angle $\beta$ essentially equal to said angle $\alpha$; said transverse cross section of said lower end of said shaft is tapered at an angle $\gamma$; and said transverse cross section of said slot in said blade member is tapered at an angle $\delta$ essentially equal to angle $\gamma$.

7. A method according to claim 6, wherein said forming of said blade member causes said back side to bow and said deforming step essentially flattens said blade member to cause a taper at said angle $\delta$ in the transverse cross section of said slot.

8. A method according to claim 6, wherein said forming of said blade member causes said blade member to be essentially flat and said deforming step bends said flanges toward the center of said slot to cause a taper at said angle $\delta$ in the transverse cross section of said slot.

9. An improved tool in accordance with claim 4 wherein angles $\gamma$ and $\delta$ differ from each other by no more than about one degree.

* * * * *